US005536276A

United States Patent [19]

Fujitani et al.

[11] Patent Number: 5,536,276

[45] Date of Patent: Jul. 16, 1996

[54] FORMALDEHYDE-UNTREATED CELLULOSE FIBER ARTICLES AND PROCESS FOR PRODUCING SAME

[75] Inventors: Kango Fujitani, Uji; Yoko Fukuyama, Ichikawa, both of Japan

[73] Assignee: New Japan Chemical Co., Ltd., Kyoto, Japan

[21] Appl. No.: 457,578

[22] Filed: Jun. 1, 1995

[30] Foreign Application Priority Data

Jun. 20, 1994 [JP] Japan ..... 6-137211

[51] Int. Cl.[6] ..... D06M 13/192

[52] U.S. Cl. ..... 8/120; 8/116.1

[58] Field of Search ..... 8/120, 127.1, 116.1, 8/181

[56] References Cited

U.S. PATENT DOCUMENTS 3,526,048 6/1967 Rowland et al. ..... 8/120

4,820,307 4/1989 Welch et al. ..... 8/120

4,833,272 5/1989 Nakazawa et al. ..... 562/523

*Primary Examiner*—Prince Willis, Jr.

*Assistant Examiner*—Alan D. Diamond

*Attorney, Agent, or Firm*—Larson and Taylor

[57] ABSTRACT

In treating a cellulose fiber article with 1,2,3,4-butanetetracarboxylic acid to improve properties, 1,2,3,4-butanetetracarboxylic acid containing up to 200 ppm of nitro radical is used, whereby the cellulose fiber article can be prevented from coloring to the utmost extent. The intended results of the invention can be achieved to a remarkable extent when using 1,2,3,4-butanetetracarboxylic acid containing up to 200 ppm of nitro radical and prepared by oxidizing tetrahydrophthalc acid and/or tetrahydrophthalic anhydride with hydrogen peroxide.

2 Claims, No Drawings

FORMALDEHYDE-UNTREATED CELLULOSE FIBER ARTICLES AND PROCESS FOR PRODUCING SAME

TECHNICAL FIELD

The present invention relates to cellulose fiber articles formaldehyde-untreated but treated with 1,2,3,4-butanetetracarboxylic acid, and a process for producing the articles.

TECHNICAL BACKGROUND

Cellulose fibers, typically cotton, are widely used because of their various advantages, e.g. hygroscopicity and good feel. However, cellulose fibers suffer the drawbacks of being susceptible to wrinkling and shrinking. To eliminate the drawbacks, a wide variety of substances have been used for treating cellulose fibers.

Urea-formaldehyde resins or their derivatives, e.g. glyoxal resins, have been extensively used as a cellulose fiber-treating agent, but they are defective. When used as such treating agent, formaldehyde is likely to remain in the cellulose fibers treated with the resin. Moreover, formaldehyde is notorious not only for its offensive odor but as a carcinogen. In treating cellulose fibers, formaldehyde may foul the work environment and may produce an adverse effect on consumers due to its presence in cellulose fiber articles.

From the viewpoint of improved safety, there is a tendency in recent years to urge a strict regulation on the use of carcinogenic formaldehyde or to tighten control of its use. Currently awaited is the .advent of epoch-making cellulose fibers having resistance to wrinkling and shrinking imparted without use of a formaldehyde derivative such as glyoxal.

U.S. Pat. No. 3,526,048 to Roland et al proposed a polycarboxylic acid, e.g. 1,2,3,4-butanetetracarboxylic acid (hereinafter referred to as "BTC"), as a formaldehyde-free, effective cellulose fiber-treating agent. U.S. Pat. No.4,820,307 to Welch et al proposed alkali metal salts of hypophosphorous acid, phosphorous acid, polyphosphoric acid or the like as a catalyst for the esterification between the cellulose fibers and polycarboxylic acid.

BTC is commercially manufactured by oxidizing tetrahydrophthalic anhydride with nitric acid (CMC, 1990 year edition, Fine Chemical Yearbook, pp. 410, 1989). Welch et al reported that when cellulose fibers, e.g. white cotton, are treated according to U.S. Pat. Nos. 3,526,048 and 4,820,307 with BTC prepared by oxidation with nitric acid (hereinafter referred to as "nitric acid BTC"), the white cotton turned yellow (Text. Chem. Color, 25, 25 (1993)). Such coloring is undesirable whether on pigmented cotton or on white cotton. Consequently conventional nitric acid BTC remains to be improved in this respect for commercial use as a fiber-treating agent.

DISCLOSURE OF THE INVENTION

An object of the present invention is to provide a method of treating cellulose fiber articles with BTC for improvement of properties according to U.S. Pat. Nos.3,526,048 and 4,820,307, the method being capable of inhibiting the coloring of cellulose fibers to the utmost extent.

Another object of the invention is to provide cellulose fiber articles treated by a method capable of preventing the coloring of cellulose fiber articles as much as possible.

These and other objects of the invention will become more apparent from the following description.

The inventors of the present invention conducted extensive research to achieve the foregoing objects, directing their attention to the quality of BTC to be used for treatment of cellulose fibers. Their subsequent intensive investigations found the following facts.

(1) Nitric acid BTC usually contains 0.5 to 1% by weight of nitro radical.

(2) Cellulose fiber articles can be prevented from coloring by reducing the content of nitro radical in BTC to a specific range.

(3) Cellulose fiber articles can be appreciably inhibited from coloring when treated with BTC prepared by the method which the present inventors proposed in Japanese Unexamined Patent Publication No. 30,737/1987 and U.S. Pat. No. 4,833,272, namely the method comprising oxidizing tetrahydrophthalc acid and/or tetrahydrophthalic anhydride with hydrogen peroxide (hereinafter referred to as "hydrogen peroxide BTC").

The present invention has been accomplished based on these novel findings.

According to the present invention, there is provided a process for preparing a formaldehyde-untreated cellulose fiber article with improved properties, wherein 1,2,3,4-butanetetracarboxylic acid containing up to 200 ppm of nitro radical is used in treating a cellulose fiber article to improve properties, and there is also provided a cellulose fiber article prepared by said process.

The term "cellulose fibers" used herein refers to natural cellulose fibers such as cotton, hemp, etc., cellulose-containing synthetic fibers such as rayon, and mixed fibers comprising said fibers and cellulose-free synthetic fibers such as polyester, liquid crystal polyester, polyamide (nylon), liquid crystal polyamide, polyacrylonitrile, polyethylene, polypropylene, spandex, etc. The term "article of cellulose fibers" used herein includes woven fabrics, knitted fabrics, nonwoven fabrics, papers, cotton, yarns and the like which are made of such cellulose fibers.

In the process of the invention, it is essential to use BTC containing up to 200 ppm of nitro radical in treating cellulose fiber articles. The nitro radical content is preferably up to 100 ppm, more preferably up to 50 ppm. When an article of cellulose fibers is treated with BTC containing more than 200 ppm of nitro radical, a pronouncedly colored article is undesirably provided.

BTC containing up to 200 ppm of nitro radical can be prepared, for example, by the following methods.

A method (hereinafter first method) is employable which comprises purifying a nitric acid BTC raw product. Stated more specifically, a nitric acid BTC raw product is prepared by oxidizing tetrahydrophthalic acid with nitric acid in the presence of a metal catalyst according to Japanese Unexamined Patent Publication No.128350/1984. The first method comprises dissolving the nitric acid BTC raw product in water or in a mixture of water and an organic solvent (such as t-butanol, acetone or the like), and removing the insoluble nitro compound of the BTC raw product from the solution by at least one conventional purifying means or a suitable combination of means selected from, e.g. filtration, recrystallization, treatment with an adsorbent (activated carbon, clay, etc.) and the like to reduce the nitro radical content in the BTC.

Also available is a method (hereinafter second method) which comprises oxidizing tetrahydrophthalic acid and/or tetrahydrophthalic anhydride with hydrogen peroxide. This method can substantially completely remove the nitro radical from BTC and is commercially advantageous.

The second method (hereinafter referred to as "NJC method") is specifically described below in more detail by way of example according to Japanese Unexamined Patent Publication No.30,737/1987 and U.S. Pat. No. 4,833,272.

Tetrahydrophthalc acid and/or tetrahydrophthalic anhydride is oxidized with hydrogen peroxide in the presence of at least one catalyst selected from the group consisting of tungstic acid, molybdic acid and heteropoly acids derived from said acids.

The heteropoly acid is a polyacid derived from at least two oxygen-containing acids. The polyacid atoms of the heteropoly acid are tungsten and molybdenum. Usable as the hetero atoms are P, As, Si, Ti, Co, Fe, B, V, Be, I, Ni, Ga, etc. At least two of these hetero atoms may be present in mixture.

While tungstic acid, molybdic acid and heteropoly acids derived from said acids can be used as the catalyst herein, tungstic acid, molybdic acid and heteropoly acids derived from said acids and containing P or Si as a hetero atom are preferred since they can be easily prepared and are readily available. More preferred are 12-tungstophosphoric acid, 12-tungstosilicic acid and 12-molybdophosphoric acid.

The tungstic acid, molybdic acid and heteropoly acids derived from said acids for use herein may be a hydrate thereof or may be a compound capable of producing tungstic acid, molybdic acid or heteropoly acids derived from said acids in the reaction system. Specific examples of compounds capable of producing tungstic acid or molybdic acid are salts of potassium, sodium or like alkali metals, salts of cobalt, nickel, manganese, copper or like heavy metals, ammonium salts, oxides, chlorides and sulfides of tungstic acid or molybdic acid, etc. When salts, oxides or sulfides of tungstic or molybdic acid are used, it is desirable that phosphoric acid, hydrochloric acid, sulfuric acid or like mineral acids be added to the reaction system and that an oxidation reaction be conducted under acidic conditions of pH 4 or less. Specific examples of compounds capable of producing heteropoly acids are salts of heteropoly acids such as alkali metal salts, ammonium salts, monoalkylammonium salts, dialkylammonium salts, trialkylammonium salts, tetraalkylammonium salts and alkylpyridinium salts of heteropoly acids, etc.

Generally the oxidation reaction is performed as follows. A reactor is charged with tetrahydrophthalc acid and/or tetrahydrophthalic anhydride (hereinafter referred to as "substrate"). Hydrogen peroxide is added and a reaction is carried out with stirring in a solvent at room temperature or an elevated temperature. The catalyst may be added at the start or in the course of the reaction.

The concentration of the substrate in the reaction mixture is not specifically limited and can be selected from a wide range in which the substrate is not dissolved during reaction. When BTC is isolated by crystallization from a cooled reaction mixture after completion of reaction, it is beneficial from the viewpoints of the amount and quality of precipitated crystals that the concentration of the substrate be 2 to 70% by weight, preferably 20 to 50% by weight.

The amount of the catalyst to be used is not specifically limited and can be suitably selected from a wide range which is effective in producing a catalytic activity. A suitable amount range is 0.1 to 30% by weight, preferably 1 to 10% by weight, based on the substrate from the viewpoints of a reaction rate and a catalyst cost.

While the stoichiometric amount of hydrogen peroxide to be used in the reaction is 4 moles per mole of the substrate, it is preferred to use hydrogen peroxide by 10 to 50% in excess of the amount. The concentration of hydrogen peroxide in the reaction mixture can be selected from a wide range. The lower limit of the range is a level sufficient for hydrogen peroxide to enable the catalyst having oxidized the substrate to recover its oxidizing ability. Even if hydrogen peroxide is used at a significantly low concentration, the oxidation reaction proceeds although at a decreased rate. The upper limit of the range is not specifically limited and may be a high level. It is suitable that the concentration of hydrogen peroxide be 0.1 mmol/l to 12 mol/l, preferably 10 mmol/l to 8 mol/l from the viewpoints of a higher reaction rate and a production cost lowered due to the use of hydrogen peroxide at a low concentration. Usually hydrogen peroxide is used in the form of an aqueous solution in the practice of the invention.

Solvents which can be used in the reaction include, for example, water, alcohols having 1 to 4 carbon atoms, carboxylic acids having 1 to 4 carbon atoms, dioxane, tetrahydrofuran, dimethylformamide and like water-miscible organic solvents. Among them, water is preferred. Water and the organic solvent can be used in combination insofar as the homogeneous phase can be retained.

The reaction proceeds at either room temperature or an elevated temperature, and is usually conducted at 20° to 150° C. A preferred reaction temperature is 50° to 130° C. from the viewpoints of a high reaction rate and prevention or alleviation of decomposition of hydrogen peroxide.

The reaction time is variable depending on the concentrations of substrate, catalyst and hydrogen peroxide, reaction temperature, etc., but usually 1 to 24 hours.

After completion of reaction, the obtained BTC can be isolated from the reaction mixture by various methods. An advantageous method is crystallization of BTC by gradually cooling the reaction mixture. When a heteropoly acid is used as the catalyst, or preferably when tungsten is used as the polyacid atom, the acid is dissolved in the reaction solvent, and consequently a highly clear reaction mixture can be produced. In such case, when the reaction mixture is slowly cooled, the BTC separates out as plates and can be easily isolated by filtration from a mother liquor having the catalyst and the unreacted substrate dissolved therein. After removal of BTC, the mother liquor can be subjected to reaction again and retains the catalyst which has not been inactivated. The isolated BTC plates are dried or, when required, washed with water or the like and are recrystallized for purification.

When tungstic acid or molybdic acid is used as the catalyst, the catalyst tends to separate out as the concentration of hydrogen peroxide decreases in the course of reaction. On precipitation of the catalyst, the produced BTC is deposited as needles or fine plates containing the precipitated catalyst as the nucleus, when the reaction mixture is slowly cooled. In this case, the reaction mixture may be provided in the form of a slurry from which BTC can not be easily isolated. Accordingly when tungstic acid or molybdic acid is used as the catalyst, it is desirable that the hydrogen peroxide be maintained at a concentration sufficient to retain the catalyst dissolved during isolation after completion of reaction, or that the precipitated catalyst be separated by filtration or like means on completion of reaction, followed by crystallization of BTC. These procedures can isolate the contemplated BTC in a yield and with a purity which are as high as when a hetropoly acid is used as the catalyst.

The NJC method is described above mainly in respect of the basic techniques of the second method. Technologies relevant to the NJC method is set forth in U.S. Pat. No. 5,047,582.

The desired BTC can be prepared by other methods than the first and second methods. For example, maleic acid or a derivative thereof is converted into a dimer by electrolysis (third method), or an ozonide prepared using tetrahydrophthalic acid and/or tetrahydrophthalic anhydride is oxidized (fourth method), or tetrahydrophthalic acid and/or tetrahydrophthalic anhydride is oxidized in the presence of aldehyde (fifth method).

Among the foregoing methods, the second method is the most preferred because BTC can be easily produced by the method and, moreover, because the obtained BTC has a superior property of preventing the coloring of cellulose fiber articles.

According to the present invention, the cellulose fiber articles can be treated with the BTC prepared by said various methods, namely the BTC containing up to 200 ppm of nitro radical. The treatment can be conducted by any of conventional methods. For example, the cellulose fiber article and BTC are subjected to an esterification reaction in the presence of a catalyst as disclosed in U.S. Pat. No. 4,820,307.

The proportions of the cellulose fiber article and the BTC used are not specifically limited in the practice of the invention. Typically 0.1 to 50% by weight, more typically 0.5 to 20% by weight, of BTC is used based on the cellulose fiber article. A smaller proportion of BTC used entails difficulty in imparting the resistance to wrinkling or other properties, whereas a greater proportion of BTC used fails to produce the corresponding degree of effect, and is uneconomical.

Catalysts useful for esterification are selectable from a wide range of conventional catalysts and include, for example, sodium hypophosphite or like alkali metal salts of hypophosphorous acid, disodium phosphite or like alkali metal salts of phosphorous acid, disodium pyrophosphate, tetrasodium pyrophosphate, sodium tripolyphosphate, pentasodium tripolyphosphate, sodium hexametaphosphate and like alkali metal salts of polyphosphoric acids, sodium carbonate, sodium malate, sodium tartrate, sodium citrate, etc.

The catalyst is used in an amount of 0.1 to 50% by weight, preferably 0.5 to 20% by weight, based on the cellulose fiber article. Either a smaller proportion or a greater proportion of the catalyst used would be unlikely to impart resistance to wrinkling and other properties, and is hence undesirable.

Cellulose fiber articles are usually treated with a treating solution containing BTC and a catalyst for esterification.

The BTC-containing treating solution may further contain conventional additives including polyols such as polyethylene glycols, silicones for treating fibers such as amino-modified silicones and polyether-modified silicones, polyethylene emulsions, fluorescents, etc.

Solvents useful for the treating solution include, for example, dimethylformamide, dimethylacetamide (DMAC) and like organic solvents. From the viewpoints of safety and economy, water is suitable for use as such solvent.

In treatment for improving properties according to the invention, cellulose fiber articles are impregnated with BTC, a catalyst for esterification and the like and are heated.

Cellulose fiber articles can be impregnated with BTC and the like by various conventional methods, for example, by dipping, padding, spraying or coating. The dipping method is preferred in the practice of the invention. Cellulose fiber articles are impregnated with the treating solution at a high rate, and the dipping time and the bath temperature are not specifically limited. Usually the dipping time is 0.5 to 300 seconds and the bath temperature is 10° to 40° C.

In the practice of the invention, the cellulose fiber articles thus impregnated may be dried, after squeezing when so required, prior to subsequent heating. The squeezing is carried out by methods under conditions varying depending on cellulose fiber articles to be treated. A squeezing method and a squeezing ratio optimum for each cellulose fiber articles are selected. Generally a proper squeezing ratio is 30 to 200%. The articles are dried at a temperature of 40° to 150° C. The drying time is properly selected according to the drying temperature.

An esterification is induced by subsequent heat treatment, whereby BTC is caused to bind with the cellulose of cellulose fibers by ester linkage. The heat treatment is conducted by air-heating or heating through contact using a press or by a combination of these procedures. The procedure is done at a temperature of 80° to 250° C., preferably 120° to 200° C. The heat-treating time is from about 1 second to 1 hour although it depends on the heating temperature.

If the heating temperature is lower than said range, the degree of esterification is insufficient to combine the cellulose with BTC, whereas a higher heating temperature tends to degrade the properties of fibers and to reduce the strength. Consequently the heating temperature outside said range is undesirable.

When required, the cellulose fiber articles treated by said methods are made into the intended garments or other products by washing with water, soaping, sewing, etc.

BEST MODE TO CARRY OUT THE INVENTION

The present invention will be described below in greater detail with reference to Reference Examples, Examples and Comparative Examples. The properties of cellulose fibers improved by the treatment with BTC were evaluated by the following methods. Method of evaluating the whiteness degree of BTC-treated fiber articles

(1) Whiteness Degree by Reflectance

A fabric test piece was irradiated with light rays at a wavelength of 550 nm and the reflectance was expressed based on that of magnesium oxide taken as 100%. A reflectance measuring device, TC-6D(trademark. product of Tokyo Denshoku KK), was used.

(2) Visual Evaluation

Ten persons visually observed and evaluated the degree of coloring of cured fabric test pieces compared with an untreated fabric test piece. The results were rated with the following 4-graded criteria.

1. No change
2. Slightly colored
3. Distinctly colored
4. Pronouncedly colored Measurement of nitro radical content in BTC The content of nitrogen atom was measured using a digital total nitrogen analyzer (TN-02, trade name for a product of Mitsubishi Chemical Co., Ltd.), and a nitro radical content was calculated based on the result.

Reference Example 1

A 0.5-liter, 4-necked flask equipped with a stirrer was charged with 30 g of tetrahydrophthalic anhydride and 60 g of water. The mixture was heated to 100° C. for 30 minutes, and cooled to 70° C. Phosphotungstic acid (1 g) was added and 15 g of a 60% aqueous solution of hydrogen peroxide was added dropwise. While the mixture was maintained at 70° C., a reaction was continued for 2 hours. Then 50 g of a 60% aqueous solution of hydrogen peroxide was added. The mixture was heated to 90° C., followed. by a 10-hour reaction. The reaction mixture was slowly cooled to 10° C. to crystallize BTC. The obtained crystals were filtered and dried, giving 25 g of BTC (containing 5 ppm or less of nitro radical, hereinafter called "hydrogen peroxide BTC").

Hydrogen peroxide BTC is theoretically free of nitro radical. But the analyzer used herein was poor in precision and incapable of measuring the content of 5 ppm or less. Consequently the zero content was indicated as 5 ppm or less by the analyzer.

REFERENCE EXAMPLE 2

A 2-liter, 4-necked flask equipped with a stirrer was charged with 500 g of 50% nitric acid and 1.5 g of ammon metavanadate. While the mixture was maintained at 50° C. with stirring, 50 g of tetrahydrophthalic anhydride was gradually added. After the addition, stirring was continued at 50° C. for 3 hours. The obtained reaction mixture was slowly cooled to 10° C. to crystallize BTC. The obtained crystals were filtered and dried, giving 50 g of BTC (containing 7,000 ppm of nitro radical, hereinafter called "nitric acid BTC").

REFERENCE EXAMPLE 3

To 100 g of water was added 50 g of nitric acid BTC obtained in Reference Example 2. The mixture was heated to 80° C. After filtering off the insolubles, the solution was slowly cooled to 10° C. for crystallization. The wet crystals thus obtained were recrystallized from 60 g of water and dried, giving 18 g of BTC purified product (containing 30 ppm of nitro radical, hereinafter called "nitric acid BTC purified product 1").

REFERENCE EXAMPLE 4

To 100 g of water was added 50 g of nitric acid BTC obtained by the same reaction as in Reference Example 1. The mixture was heated to 80° C. After filtering off the insolubles, the solution was slowly cooled to 5° C. A BTC precipitate was filtered and dried, giving 30 g of BTC purified product (containing 110 ppm of nitro radical, hereinafter called "nitric acid BTC purified product 2").

EXAMPLE 1

A white cotton plain fabric test piece (100% cotton) weighing 100 g/m$^2$ was immersed in an aqueous solution of 10% by weight of hydrogen peroxide BTC and 2.2% by weight of sodium carbonate, squeezed with a mangle, dried at 80° C. for 10 minutes and cured at 190° C. for 5 minutes. The cured test piece had a whiteness degree of 86% whereas an untreated test piece showed 86% whiteness degree. The test piece was visually observed by ten persons and rated as 1 in the degree of coloring.

EXAMPLE 2

A test piece was prepared in the same manner as in Example 1 with the exception of using nitric acid BTC purified product 1. The cured test piece had a whiteness degree of 84% and an untreated test piece 86%. The test piece was visually observed and rated as 1 in the coloring degree.

COMPARATIVE EXAMPLE 1

A test piece was prepared in the same manner as in Example 1 with the exception of using nitric acid BTC. The cured test piece had a whiteness degree of 73% and an untreated test piece was 86% in whiteness degree. The test piece was visually observed and estimated at 4 in the coloring degree.

EXAMPLE 3

A white cotton plain fabric test piece (100% cotton) weighing 150 g/m$^2$ was immersed in an aqueous solution of 10% by weight of hydrogen peroxide BTC and 8% by weight of sodium hypophosphite, squeezed with a mangle, dried at 80° C. for 10 minutes and cured at 190° C. for 3 minutes. The cured test piece had a whiteness degree of 87% whereas an untreated test piece showed 87% whiteness degree. The test piece was visually inspected and rated as 1 in the coloring degree.

EXAMPLE 4

A test piece was prepared in the same manner as in Example 3 with the exception of using nitric acid BTC purified product 2. The cured test piece had a whiteness degree of 83% and an untreated test piece 87%. The test piece was visually inspected and rated as 2 in the coloring degree.

COMPARATIVE EXAMPLE 2

A test piece was prepared in the same manner as in Example 3 with the exception of using nitric acid BTC. The cured test piece had a whiteness degree of 76% and an untreated test piece was 87% in whiteness degree. The test piece was visually inspected and evaluated as 4 in the coloring degree.

The Examples and Comparative Examples show that cellulose fiber articles can be prevented from coloring when the specific BTC of the present invention is used.

What we claim is:

1. A process for preparing a formaldehyde-untreated cellulose fiber article with improved color inhibition comprising esterifying said article with 1, 2, 3, 4-butanetetracarboxylic acid, said 1, 2, 3, 4-butanetetracarboxylic acid being prepared by oxidizing tetrahydrophthalic acid or anhydride with hydrogen peroxide and recovering said 1, 2, 3, 4-butanetetracarboxylic acid.

2. A formaldehyde-untreated cellulose fiber article prepared by the process of claim 1.

* * * * *